US005788360A

United States Patent [19]

Ho

[11] Patent Number: 5,788,360

[45] Date of Patent: Aug. 4, 1998

[54] MOUNTING STRUCTURE FOR INDICATING LIGHTS AND PUSH BUTTON SWITCHES

[76] Inventor: Hsin Chien Ho, Wen-Hua Road, Pan Chiao City, Taipei, Taiwan

[21] Appl. No.: 730,802

[22] Filed: Oct. 17, 1996

[51] Int. Cl.[6] ..... F21V 21/00

[52] U.S. Cl. ..... 362/249; 362/251; 362/800

[58] Field of Search ..... 362/249, 251, 362/23, 800

[56] References Cited

U.S. PATENT DOCUMENTS 5,617,441 4/1997 Nakata et al. ..... 362/800

*Primary Examiner*—Carroll B. Dority
*Attorney, Agent, or Firm*—Pro-Techtor International

[57] ABSTRACT

A mounting structure for positioning light bulbs and push button switches in computers. The mounting structure includes a body with a plurality of light mounting seats and switch mounting seats. The light mounting seats are each provided with a central through hole having clamping and shielding plates which work in cooperation with curved slots above and below the through hole to effectively position light bulbs of acceptable tolerance, apart from enabling the light beams to concentrate and extend forwardly to prevent confused light indication. The switch mounting seats are provided with slots which may guide wires to the back of the body and receive switches of acceptable tolerance.

1 Claim, 2 Drawing Sheets

MOUNTING STRUCTURE FOR INDICATING LIGHTS AND PUSH BUTTON SWITCHES

BACKGROUND OF THE INVENTION (a) Field of the Invention

The present invention relates to a mounting structure for positioning light bulbs and push button switches in computers.

(b) Description of the Prior Art

Near the faceplates of computers there are generally provided at least one or a row of lights for indicating the operating status of the computer, such as Power, Turbo and HDD and at least a push button switch for Reset and Turbo. In general, the indicating lights are mounted by directly inserting the light bulbs into predetermined positioning slots. However, there are the following disadvantages with this method:

1. The size of the light bulbs must be uniform. If there are differences in size, the light bulbs cannot be used. If the light bulbs are too small, they may become loosened after mounting. If they are too large, they cannot be inserted into the positioning slots.

2. The light beam generated by a light bulb may overflow and penetrate through the transparent plate of adjacent light bulbs, resulting in erroneous or confused indication. (In general, the faceplate is provided with transparent plates to allow the light to get through.)

3. Additional accessories are required to secure the light bulbs.

SUMMARY OF THE INVENTION

Accordingly, a primary object of the present invention is to provide a mounting structure for positioning indicating lights and push button switches in computers, in which a body is provided with a plurality of light mounting seats and a plurality of switch mounting seats, in which the light mounting seats are each provided with a central through hole with clamping and shielding plates and curved slots disposed above and below the through hole to firmly position a light bulb inserted into the through hole and to force the light beam to concentrate and extend forwardly to prevent confused or erroneous light indication, and the switch mounting seats are each provided with a baffle block at a bottom end thereof such that after a switch is inserted into mounting seat it is stopped at the baffle block so that it may not easily displace or disengage from the seat. The switch mounting seats are further provided with slots disposed thereabove and therebelow; the plasticity of the slots enable the mounting seats to receive switches of acceptable tolerance. Besides, the slots may guide wires to the back of the body.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Figure 1:
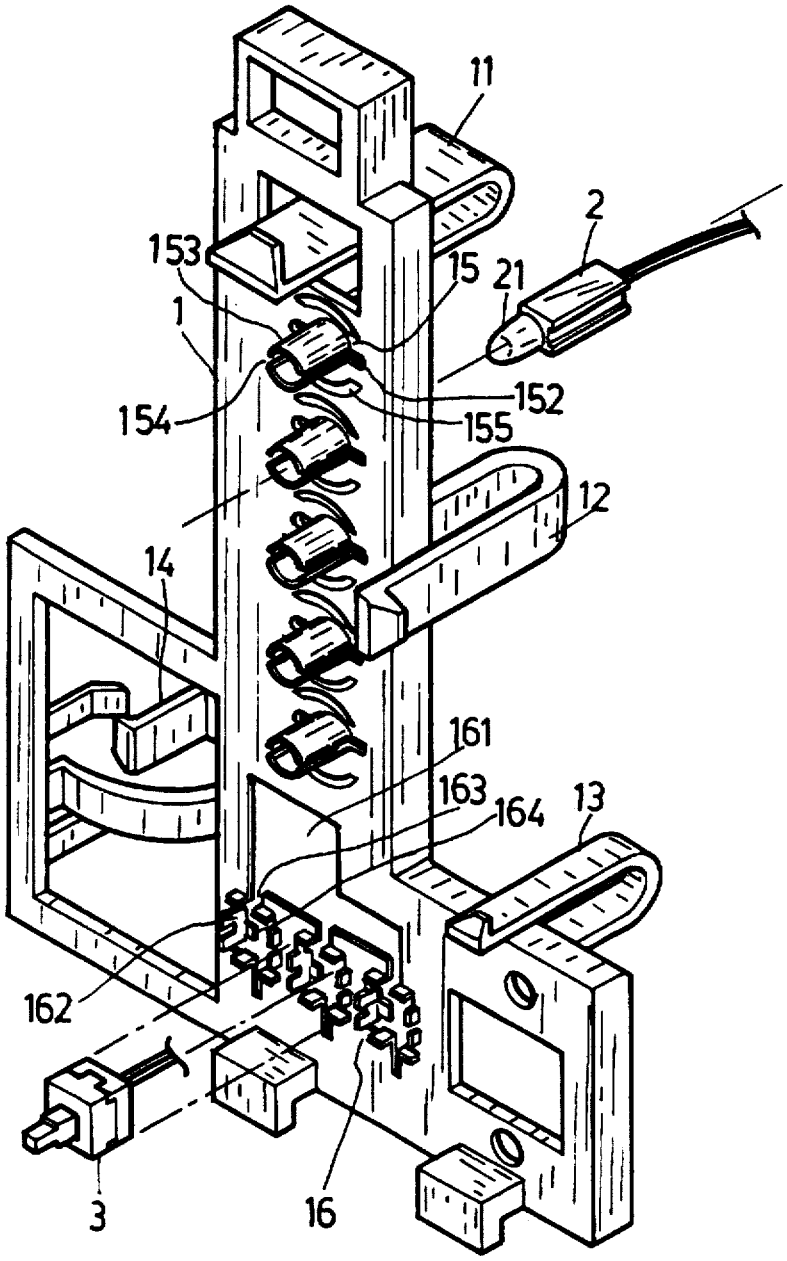
FIG. 1 is an elevational view of the present invention.
Figure 2:
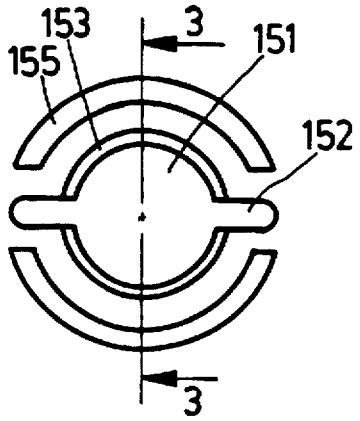
FIG. 2 is a schematic plan view of a light mounting seat according to the present invention.
Figure 3:
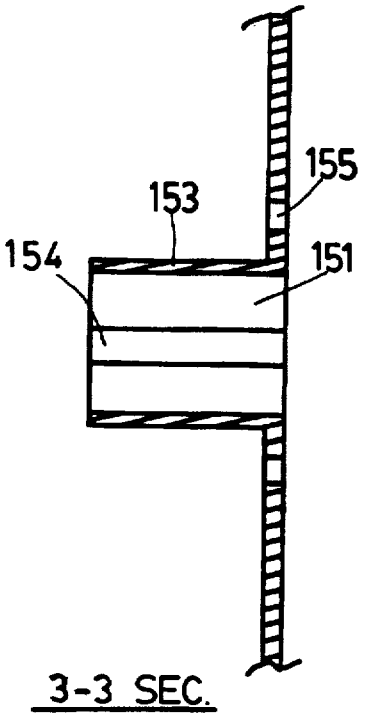
FIG. 3 is a schematic sectional view of the light mounting seat shown in FIG. 2.

With reference to FIG. 1, the mounting structure according to the present invention essentially comprises a body 1 formed by plastic injection molding. The body 1 includes a plurality of elastic hook members 11, 12, 13 and 14 for fastening onto a housing of the computer, and a plurality of light mounting seats 15 which may be longitudinally or transversely arranged in a row. Referring to FIG. 2, each light mounting seat 15 has a through hole 151 in a central portion thereof, the through hole 151 extending outwardly to either side to form two open slots 152. The outer rims of the through hole 151 may be designed to extend outwardly to form two clamping and shielding plates 153, defining an elongated slot 154 therebetween at the open slots 151. The clamping and shielding plates 153 are arranged to receive a head portion 21 of a light bulb 2. A curved slot 155 is further formed near the outer rim of each clamping and shielding plate 153. The head portion 21 of the light bulb 2 is inserted through the through hole 151 and clamped therein. By means of the arrangement of the open slots 152 at both sides of the through hole 151, the elongated slot 154 between the clamping and shielding plates 153, as well as the curved slots 155, light bulbs 2 with acceptable tolerance may be mounted in the light mounting seat 2 and firmly held therein. If the light mounting seats 2 are arranged in a longitudinal row as shown in FIG. 1, the open slots 152 at both sides of the through holes 151 and the elongated slot 154 defined by the clamping and shielding plates 153 are located to the left and right of the light mounting seats 15. But if the light mounting seats 15 are arranged in a transverse row, the open slots 152 and the elongated slot 154 are located above and below the mountings seats 15. In this way, the light beams generated by the light bulbs 2 will not overflow to cause confused or erroneous light indication.

Furthermore, the body 1 is provided with a plurality of switch mounting seats 16 arranged in a row beneath a relatively larger hole 161. Each switch mounting seat 16 has a positioning block 161 on a front rim thereof. A slot 163 is formed between adjacent switch mounting seats 16 above or below. The switch mounting seat 16 is further provided with a baffle block 164 at a bottom end thereof so that a switch 3 may be inserted with its rear side into the switch mounting seat 16 and positioned therein and then stopped at the baffle block 164 such that the switch 3 may not displace or become loosened. Moreover, wires may pass via the slots 163 to the back. Due to the plasticity of the slots 163, switches 3 of acceptable tolerance may be firmly positioned in the switch mounting seats 16.

Although the present invention has been illustrated and described with reference to the preferred embodiment thereof, it should be understood that it is in no way limited to the details of such embodiment but is capable of numerous modifications within the scope of the appended claims.

What is claimed is:

1. A mounting structure for positioning indicating lights and push button switches in computers, said mounting structure comprising:

a body having a plurality of elastic hook members for fastening onto a computer housing and a plurality of light mounting seats arranged in a longitudinal or transverse row, each of said light mounting seats having a central through hole which extends to either side to form an open slot, two outer rims of said through hole extending outwardly therefrom to form clamping and shielding plates for receiving a head portion of a light bulb and defining an elongated slot therebetween at said open slots, and a curved slot being formed to the outer rim of said clamping and shielding plates, thereby the light bulb may be inserted into each light mounting seat via said through hole; said body further having a plurality of switch mounting seats arranged in a row beneath a relatively large hole, each of said switch mounting seats having a positioning block on a front rim thereof, a slot being provided above or below between adjacent switch mounting seats for guiding wires to the back of said body, said switch mounting seats each further having a baffle block at a bottom rim thereof so that a switch may be inserted with its back into said switch mounting seat and be positioned therein and then stopped at said baffle block.

* * * * *